US005157229A

United States Patent [19]

Wu

[11] Patent Number: 5,157,229

[45] Date of Patent: Oct. 20, 1992

[54] VIDEO GAME JOYSTICK SWITCH CONTROL MECHANISM WITH POSITION ADJUSTORS

[75] Inventor: Chih P. Wu, Taipei, Taiwan

[73] Assignee: Entropy International Co., Ltd., Taiwan

[21] Appl. No.: 710,534

[22] Filed: Jun. 5, 1991

[51] Int. Cl.[5] ..... H01H 25/04

[52] U.S. Cl. ..... 200/6 A

[58] Field of Search ..... 200/6 A, 17 R, 18

[56] References Cited

U.S. PATENT DOCUMENTS 4,470,320 9/1984 Kim ..... 200/6 A X
4,749,826 6/1988 Saito ..... 200/6 A
4,918,265 4/1990 Saito ..... 200/6 A
4,926,011 5/1990 Saito ..... 200/6 A

*Primary Examiner*—J. R. Scott
*Attorney, Agent, or Firm*—Bacon & Thomas

[57] ABSTRACT

A convenient and easily reassembleable control mechanism for a video game is provided. The control mechanism includes a control rod, a mechanism body, a switch control plate, a plurality of micro switches and an actuator wherein the switch control plate has a central square hole having four defining wall corners from which the control plate is provided with a four outwardly extending grooves adjustably receiving therein four adjustors each of which can project beyond or fully be received in one respective groove so that the actuator can operate one microswitch or two adjacent microswitches at a time.

5 Claims, 7 Drawing Sheets

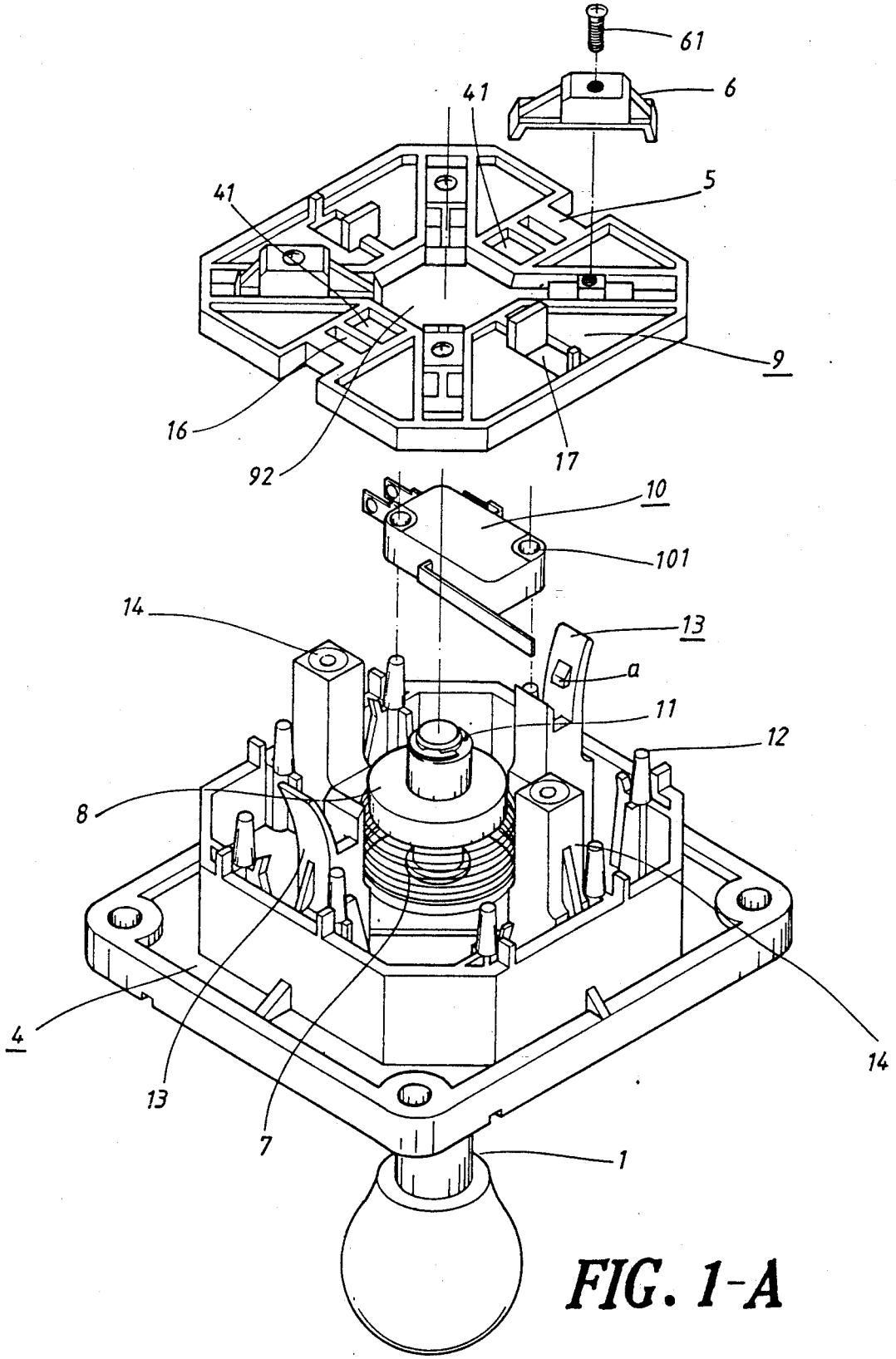
FIG. 1-A

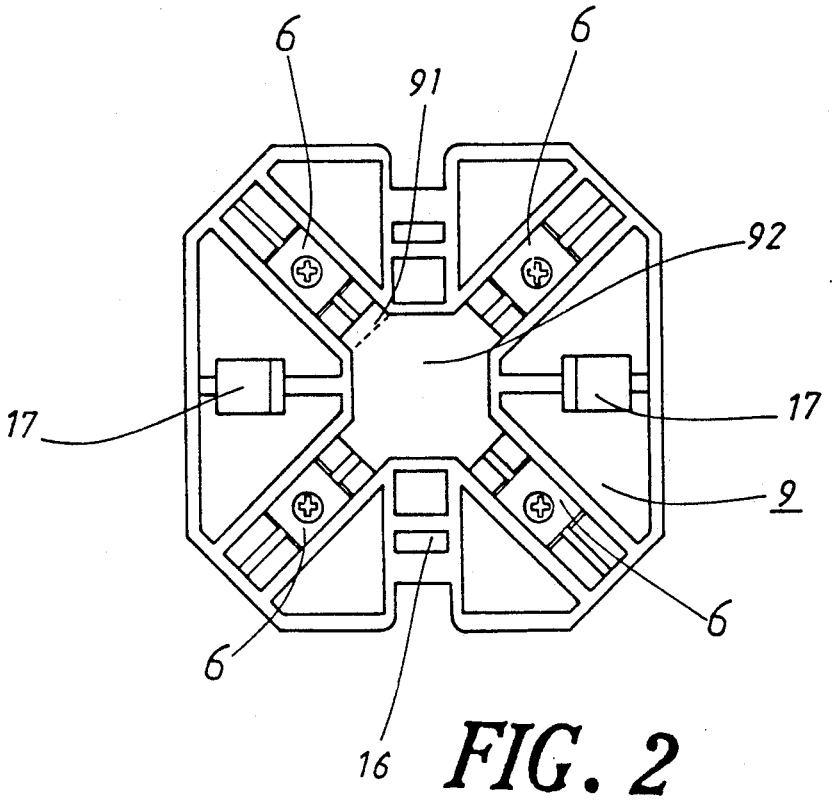
FIG. 2
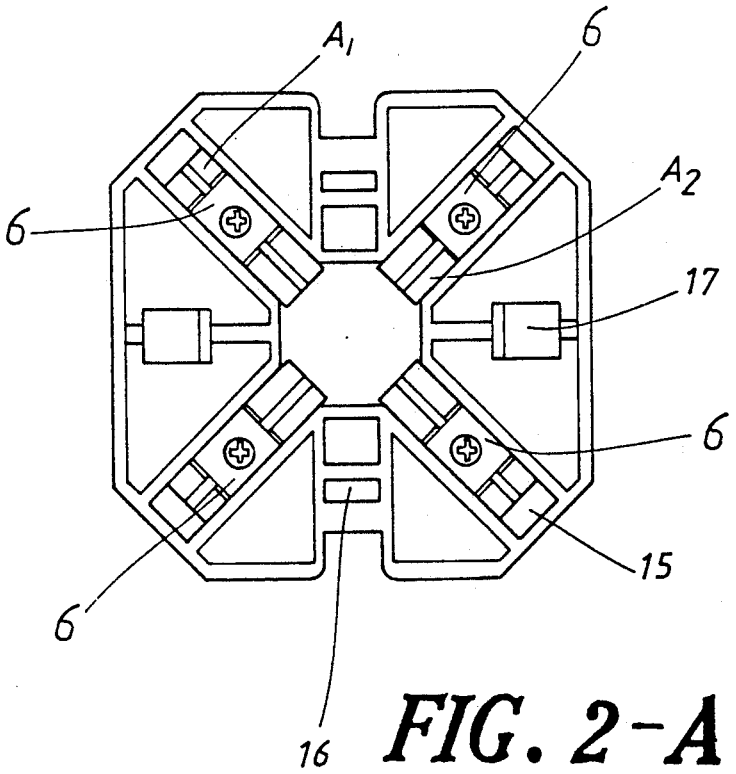
FIG. 2-A

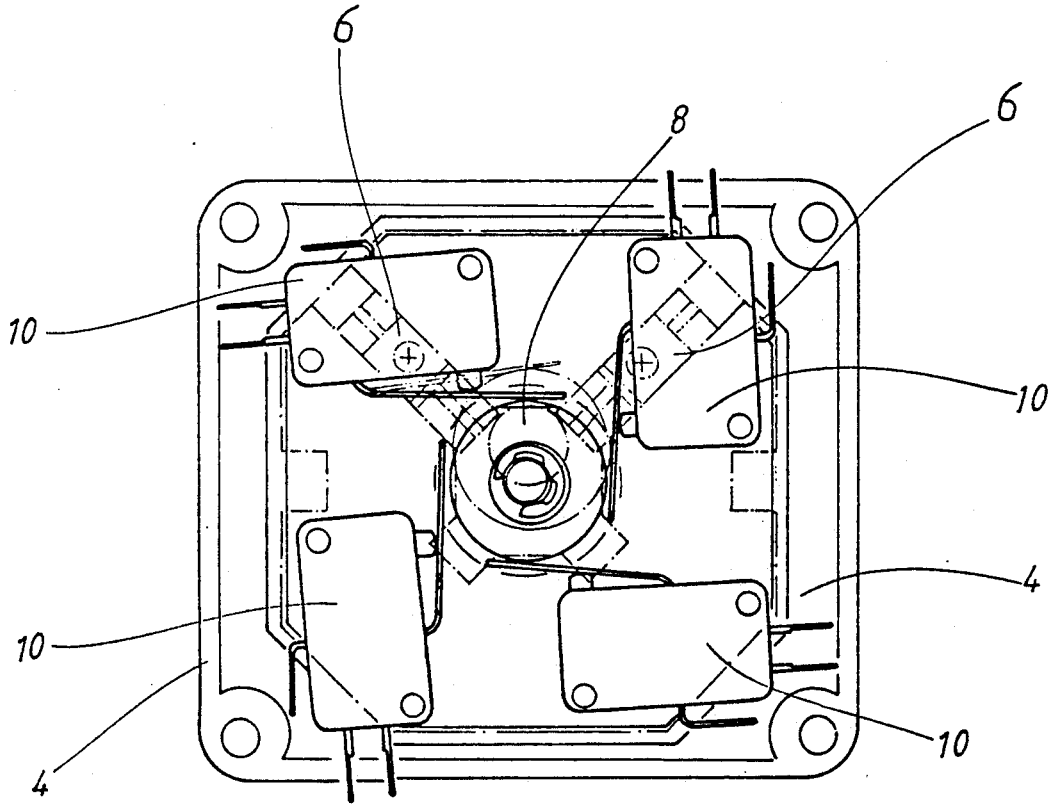
FIG. 3-A

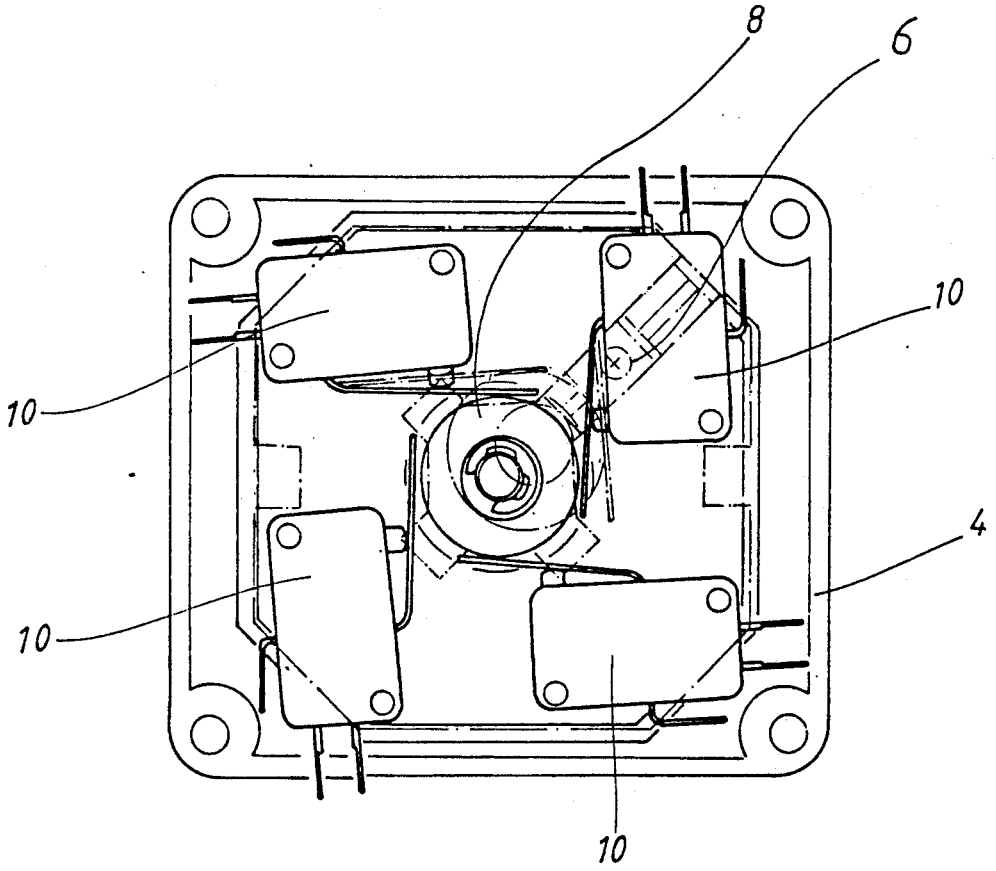
FIG. 4-A

VIDEO GAME JOYSTICK SWITCH CONTROL MECHANISM WITH POSITION ADJUSTORS

BACKGROUND OF THE INVENTION

The present invention relates to a video game, and more particularly to a control mechanism therefor.

The control rod of the conventional mechanism for a video game can normally be operated along two orthogonal axes to obtain four controlling states. Recently, a control mechanism has been developed which is capable of optionally having four or eight controlling states by detaching, adjusting the position of and reassembling the switch control plate in the mechanism. Upon detaching or reassembling the plate, it is possible for some elements of the mechanism possibly escape from their intended positions. In addition, the micro switches are screwed to the mechanism body so that it is inconvenient to replace or repair the micro switches.

SUMMARY OF THE INVENTION

It is therefore an object of the present invention to provide a convenient and easily assembleable control mechanism for a video game.

According to the present invention, a control mechanism for a video game includes a control rod, a mechanism body, a switch control plate, a plurality of micro switches and an actuator wherein the switch control plate has a central square hole having four defining wall corners from which the control plate is provided with four outwardly extending grooves adjustably receiving therein four adjustors each of which can project beyond or fully be received in one respective groove so that the actuator can operate one microswitch or two adjacent microswitches at a time.

The present invention may best be understood through the following description with reference to the accompanying drawings, in which:

FIG. 1 is an exploded view showing a preferred embodiment of a control mechanism for a video game according to the present invention;

FIG. 1-A is an exploded view of a control mechanism in FIG. 1;

FIG. 2 is a top view showing a switch control plate of a control mechanism in FIG. 1 in eight controlling states;

FIG. 2-A is a top view showing a switch control plate of a control mechanism in FIG. 1 in four controlling states;

FIG. 3 is a schematical top view showing a control mechanism in FIG. 1 in four controlling states;

FIG. 3-A is a further schematical top view showing a control mechanism in FIG. 1 in four controlling states;

FIG. 4 is a schematical top view showing a control mechanism in FIG. 1 in eight controlling states; and FIG. 4-A is further a schematical top view showing a control mechanism in FIG. 1 in eight controlling states.

DETAILED DESCRIPTION OF THE PREFERRED EMBODIMENT

Figure 1:
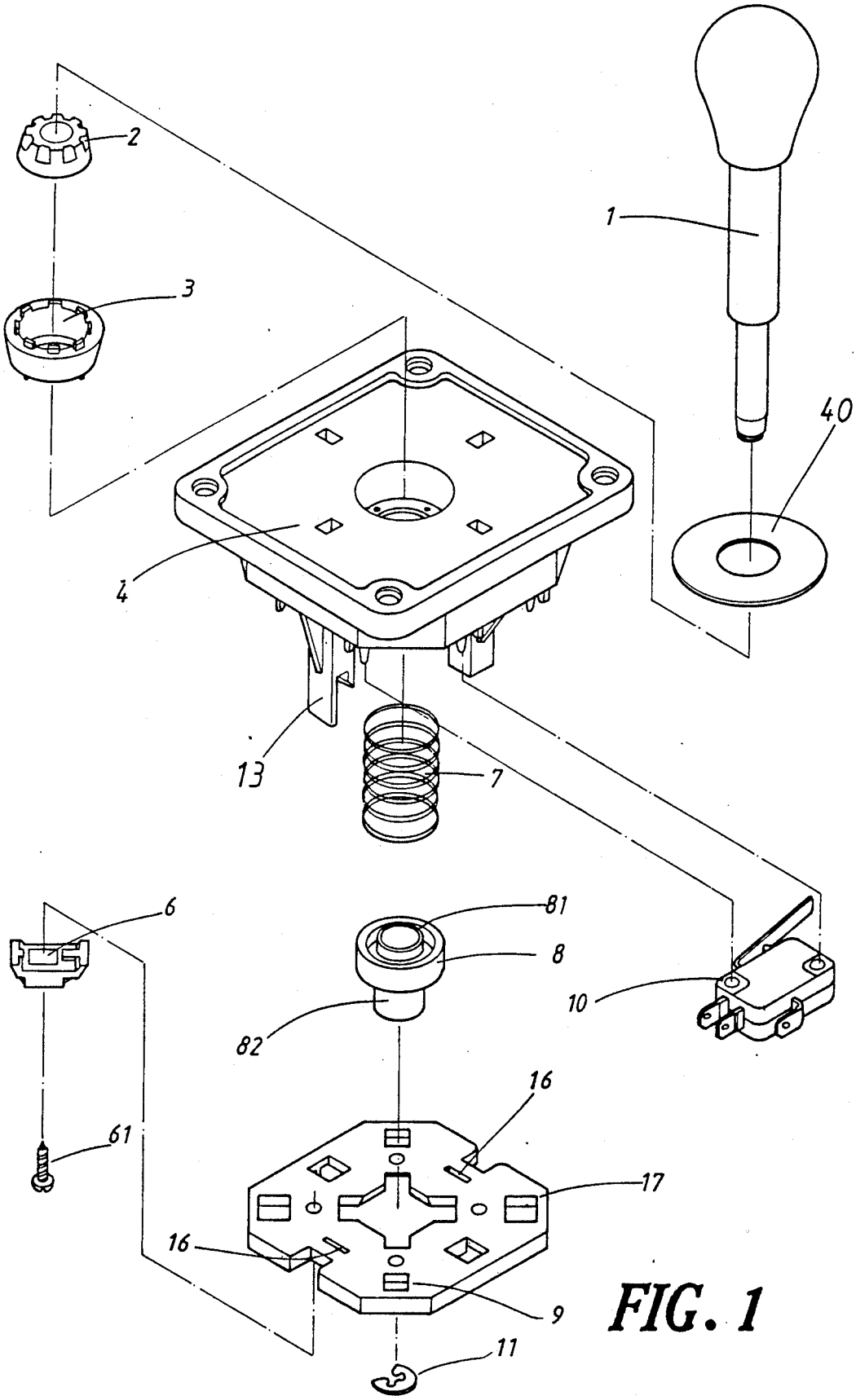

Referring now to FIGS. 1–2A, a control mechanism for a video game according to the present invention includes an iron control rod 1, a mechanism body 4, a switch control plate 9, an actuator 8, four adjustors 6 and four micro switches 10. Control rod 1 has a plastic bulbar head and passes through washer 40 and body 4, which receives therein a truncated conical ring. Ring 3 attaches at a lower one-third portion thereof to a truncated conical sleeve 2 received in ring 3 in order to confine the amount of maximum inclination with respect to body 4 to which rod 1 can be pivoted. Actuator 8 is retained on the end of rod 1 by a retainer 11 which includes a shaft portion 82 and an annular groove 81 supporting thereabove a spring 7 biased against mechanism body 4 so that spring 7 returns rod 1 to an upright position every time rod 1 is released by a game player.

Mechanism body 4 is made of a plastic material by injection molding. Control rod 1 includes two opposite cross sectionally square side positioners 14, another two opposite side pieces 13 respectively, having two barbs a, and surrounding tapered pins 12 inserted into holes 101 of micro switches 10 for connecting switches 10 thereto.

Switch control plate 9 is made of plastic and has a central square hole 92 having four defining wall corners from which plate 9 is provided with four outwardly extending grooves 15 respectively securing therein four adjustors 6 each of which includes an intermediate portion screwed to plate 9 by a bolt 61, a relatively short inclined side surface A1 and a relatively long including side surface A2 includes two square side holes 17 into which are inserted side positioners 14 and two retaining side holes 16 into which are inserted side pieces 13 having projections a, the bottom surfaces of which contact surface 5 of plate 9 when the mechanism is assembled. A recess 41 is also shown in FIG. 1A, but not in FIG. 1 because it does not extend through plate 9.

Figure 3:
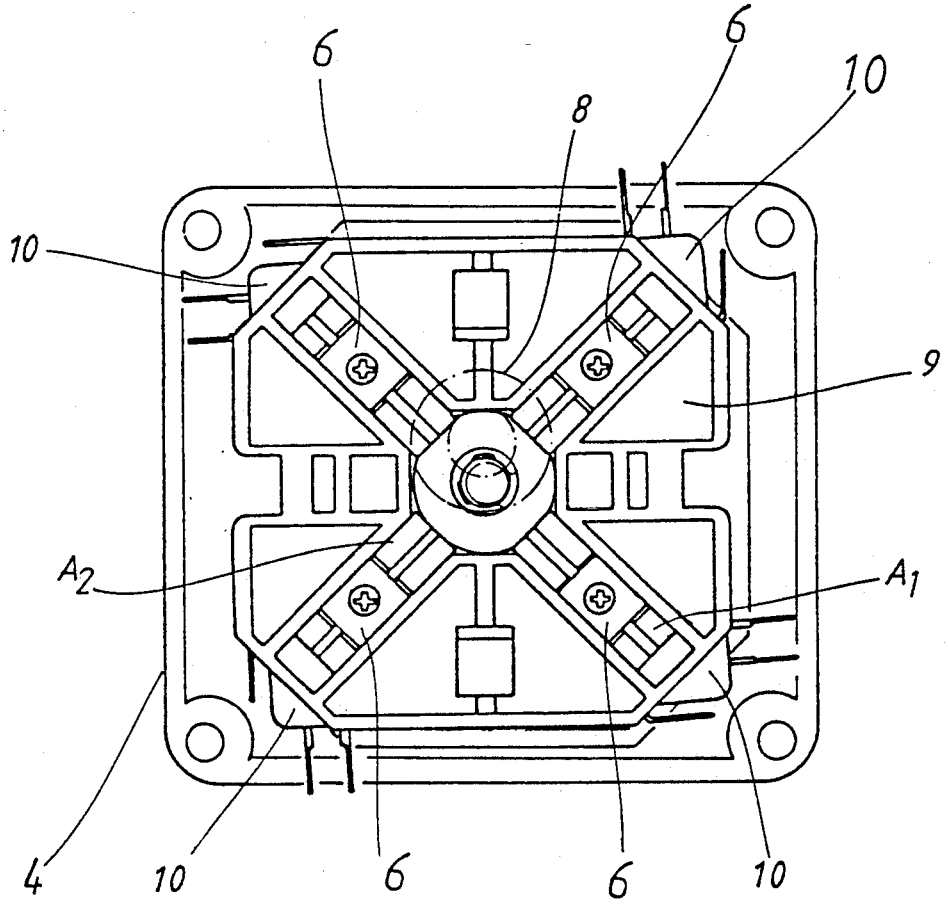
Figure 4:
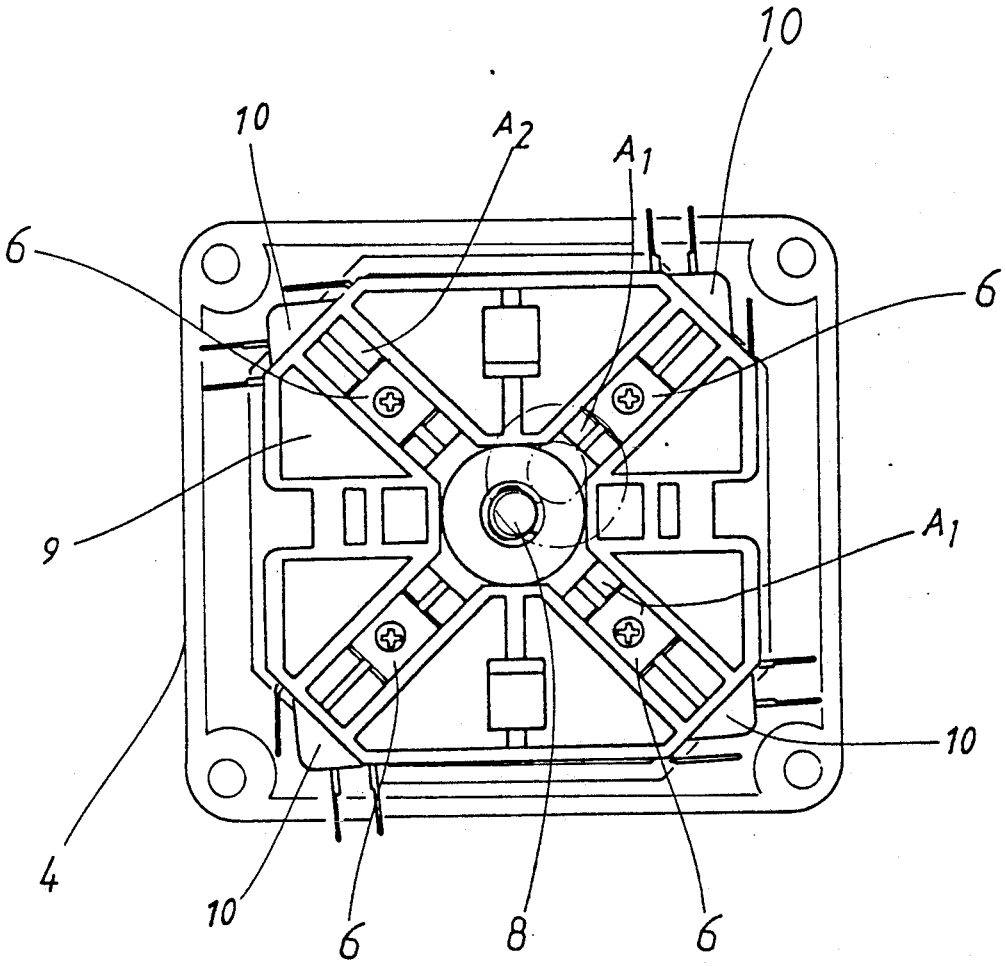

As shown in FIGS. 3 & 3A, when long surfaces A2 of adjustors 6 project beyond grooves 15 (or the dotted line 91 in FIG. 2) respectively, actuator 8 can only contact a micro switch 10 at a time when control rod 1 is inclinedly operated with respect to body 4. If adjustors 6 are inversely placed to be fully received in grooves 15 respectively as shown in FIGS. 4 & 4A, rod 1 can be so operated that shaft portion 82 will project into a particular groove 15 so that the outer wall of annular groove 81 can contact two adjacent micro switches 10 at a time to obtain four additional controlling states so that the present control mechanism can obtain a total of eight controlling states.

By projecting or fully receiving adjustors 6 respectively beyond or in grooves 15 by loosening and then re-tightening bolts 61, the present control mechanism can easily be changeably set to have four or eight controlling states.

Through the above description, it should now become readily apparent how and why the present invention can achieve the object it contemplates.

What I claim is:

1. A control mechanism for a video game, comprising a control rod mounted to pivot relative to a mechanism body through which a portion of said control rod extends;

a switch control plate mounted on the mechanism body, said switch plate including a central hole having four corners, and four grooves respectively extending outwardly from said four corners;

a plurality of microswitches;

an actuator connected to the control rod and arranged to selectively contact one or more of said microswitches to generate an electrical signal representative of a position of said rod;

four adjusters respectively received in said grooves and having means including side portions of said adjusters for determining an amount by which said actuator can enter a respective groove depending on which of said side portions is adjacent the central hole when said adjusters are positioned in said grooves, wherein said adjusters in one position extend out of said respective grooves and into said central hole, thereby restricting entry of said actuator into said grooves and permitting said actuator to contact only one of said microswitches at a time, and wherein in a second position of said adjusters, said adjusters are located completely within said grooves, thereby permitting said actuator to enter said grooves and contact more than one microswitch at a time.

2. A control mechanism as claimed in claim 1, wherein positions of said microswitches are arranged such that a number of said micro switches which can be contacted at one time is two.

3. A control mechanism as claimed in claim 1, comprising four of said microswitches.

4. A control mechanism as claimed in claim 1, wherein each said adjuster includes an intermediate portion comprising means for securing said intermediate portion to said switch control plate, and said side portions includes a first relatively short inclined side surfaces and a second relatively long inclined opposite side surface, whereby when said short side surfaces are positioned adjacent the central hole, said actuator is able to enter one of said grooves, and whereby when said long side surfaces are positioned adjacent the hole, said actuator is prevented from entering said grooves.

5. A control mechanism as claimed in claim 1, wherein said switch control plate includes two first side holes and two second side holes, and said mechanism body includes four sides, two of said sides each having a positioner member respectively engageable in one of said first holes, and another two of said sides each including a respective barbed member engageable in one of said second holes to position and secure said switch plate to said mechanism body.

* * * * *